United States Patent [19]

Kwon

[11] 4,171,503

[45] Oct. 16, 1979

[54] ELECTRODELESS FLUORESCENT LAMP

[76] Inventor: Young D. Kwon, 10125 Carol Lee Dr., Cupertino, Calif. 95014

[21] Appl. No.: 869,660

[22] Filed: Jan. 16, 1978

[51] Int. Cl.[2] ..... H05B 41/16; H05B 41/24

[52] U.S. Cl. ..... 315/248; 315/344; 336/229

[58] Field of Search ..... 315/248, 344; 336/229

[56] References Cited

U.S. PATENT DOCUMENTS

| | | | |
|---|---|---|---|
| 1,807,927 | 6/1931 | Morrison | 315/248 X |
| 2,939,049 | 5/1960 | Blackman | 315/248 X |
| 3,508,104 | 4/1970 | Braams | 313/153 X |
| 3,987,334 | 10/1976 | Anderson | 315/248 |

*Primary Examiner*—Saxfield Chatmon, Jr.
*Attorney, Agent, or Firm*—Christie, Parker & Hale

[57] ABSTRACT

An electrodeless fluorescent light source that includes a non-conducting light transmissive hermetically sealed envelope containing an ionizable gas which is electromagnetically coupled to an ionizing radio frequency (r.f.) energy source is described. The r.f. energy source is an induction coil wound in the form of a toroidal helix to minimize microwave radiation leakage, and is placed within the envelope and in direct contact with the gas in order to maximize energy coupling to the gas.

14 Claims, 7 Drawing Figures

ELECTRODELESS FLUORESCENT LAMP

BACKGROUND

1. Field of the Invention

This application relates to electrodeless fluorescent lamps, more particularly, to minimizing microwave leakage radiation by the use of an induction coil wound in the form of a toroidal helix.

2. Description of the Prior Art

Electrodeless fluorescent lamps are known in the prior art. One class of device is described by J. M. Anderson in U.S. Pat. Nos. 3,500,118 and 3,521,120. Operation of the described devices relies on the use of ferrite induction cores to transfer power into electrodeless discharges. Ferrite materials when used in such applications are characterized by considerable inefficiency. Use of ferrite materials increases core inductance to such an extent that high frequency operation is impossible, thereby making them inherently low frequency devices. Additionally, hysteresis and eddy current losses in the core result in energy loss as well as heating of the ferrite materials. At elevated temperatures (100° C.–150° C.) ferrite cores change from ferromagnetic to paramagnetic resulting in a substantial reduction in their permeability. With such a permeability decrease, coil inductance drops rapidly, the induced magnetic field decreases substantially and ionization of the lamp medium cannot be sustained. In radio frequency (r.f.) electrical energy sources, relying on the coil inductance as a load, thermal runaway of the output driver occurs since a very low impedance now appears across the output driver. Also, the cost of a suitable ferrite core is of the same order as the remainder of the r.f. power source. Thus, not only does use of such a core result in system inefficiency and reduce its reliability but it significantly raises the cost of the overall device as well. An alternative approach to the use of a ferrite core is described by D. Hollister in U.S. Pat. No. 4,010,400 and is based upon the technique of placing a cylindrical induction wrapped coil in a helical form around a non-conductive, non-magnetic mandrel in close proximity to an ionizable medium. Structurally, the lamp is composed of a hollow glass envelope generally of an incandescent bulb shape and having a cylindrical cavity into which the cylindrical induction coil is placed. The interior wall of the envelope is coated with a layer of fluorescent light emitting phosphor that is capable of emitting white light within the visible spectrum upon absorption of ultraviolet radiation. The ultraviolet radiation is generated upon ionization of the medium within the envelope. Typically, the gaseous charge used in such an envelope consists of mercury vapor and an inert starting gas such as argon, helium or neon. After initiating an electrodeless discharge in the ionizable medium, the discharge is maintained by coupling the medium to an r.f. magnetic induction field having a frequency and magnitude such that free electrons are accelerated to ionizing velocity within one quarter of the period of the field frequency. The field must also be of requisite strength to sustain the ionization process, placing severe requirements upon radio frequency power delivery.

A drawback in the generation of the r.f. induction field in prior art devices such as the one just described with a cylindrical induction coil is that the lines of flux are not confined within the envelope but radiate outwardly to the surrounding area. Two significant problems arise from this electromagnetic radiation.

Firstly, since the microwave radiation is not confined to the envelope, its influence will be felt in the surrounding spaces. Definite health hazards exist and negative effects to human beings can be realized with sustained exposures to such microwave radiation. The microwave radiation emission will also interfere with radio and television reception as well as other communication transmission.

Secondly, cylindrical coil flux patterns provide maximum field density in the center of the cylinder where no ionizing gas exists. Thus, maximum flux density is not utilized for coupling with the ionizable medium and in addition, a substantial portion of the field escapes from the lamp into the space surrounding the lamp. Techniques for controlling such emissions are available. By fixing the oscillator frequency within a specific range, interference may be reduced. Typically, such control is achieved using a crystal controlled oscillator. However, the attendant cost factor would severly diminish marketability of the device. To minimize power dissipation, the radio frequency oscillator has to be overdriven. However, a severe penalty is paid in that r.f. harmonics are generated, which can interfere with communication signals. Microwave shielding, having the properties of optical transparency and electrical conductivity, can be used to coat the light bulb. But the best transparent conductive film known today is not completely transparent and would, therefore, lower the overall efficiency of the lamp. Such coatings would again provide additional cost factors.

SUMMARY OF THE INVENTION

According to a presently preferred embodiment, there is provided an electrodeless fluorescent lamp comprising a transparent sealed envelope containing an ionizable medium. Ionization of the medium is sustained by coupling it to a radio frequency magentic induction field positioned so that a substantial portion of its magnetic induction field passes through the ionizable medium. The induction field is generated by a coil wound in the form of a toroidal helix and is energized by radio frequency (r.f.) power source housed within the lamp assembly.

A particular advance over the state of the art in electrodeless fluorescent lamps is the use of the toroidal helix to generate the magnetic induction field. Magnetic cancellation occurs at all points about the coil thus restricting the magnetic lines of force essentially to within the toroid. The field confinement, therefore, minimizes if not completely eliminates, the possibility of microwave radiation, thus ameliorating the potential of health and safety hazards.

Preferably the toroidal helix is placed within the sealed envelope so that the induced field is maximally coupled with the ionizable gas medium.

DETAILED DESCRIPTION

Figure 1:
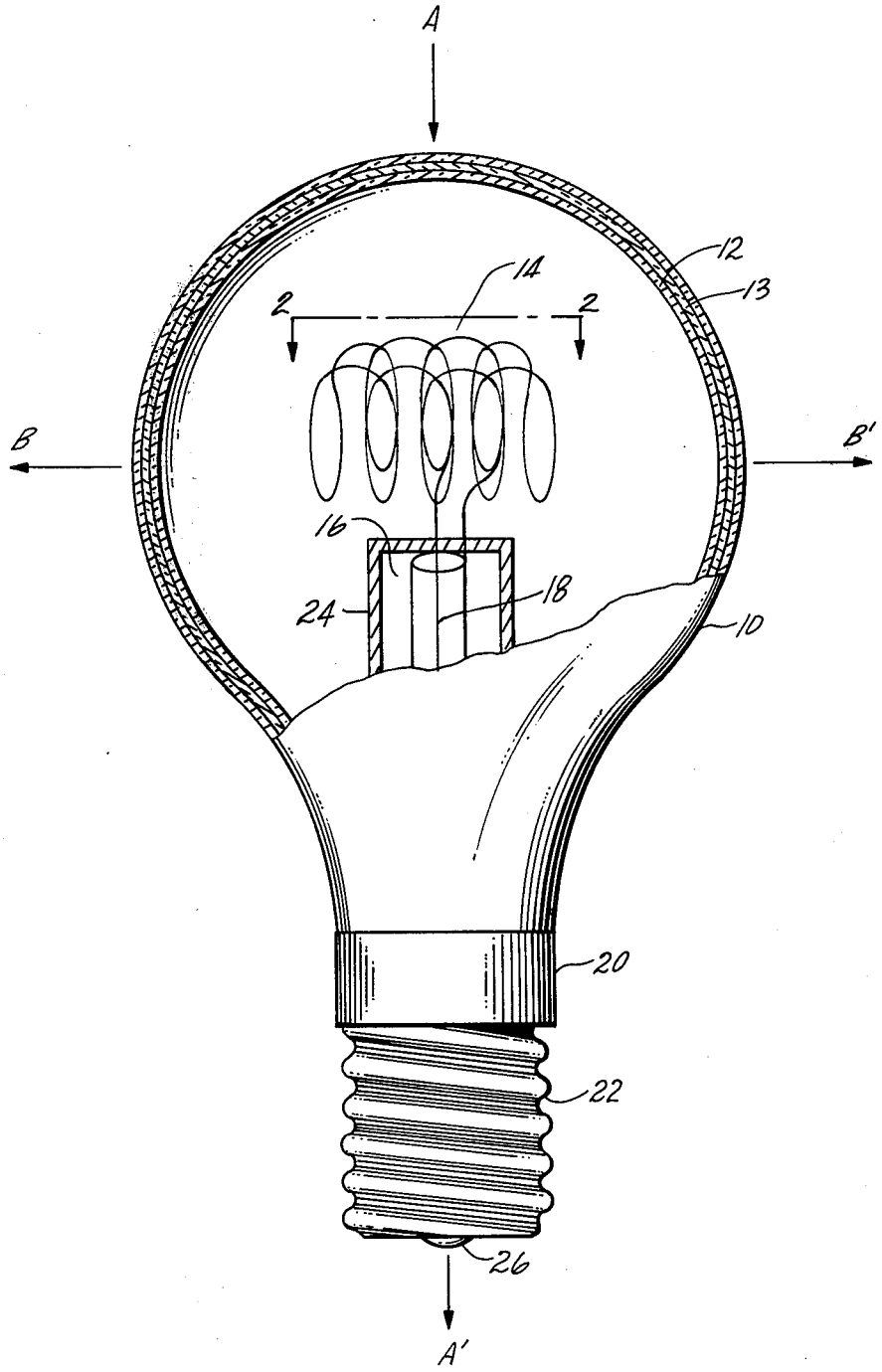
FIG. 1 is a partial cutaway view of an electrodeless discharge lamp with a toroidal helix induction coil.

In FIG. 1, there is illustrated in a partially cutaway side view of an electrodeless fluorescent lamp, a light transmissive non-conductive sealed glass envelope 10 containing an ionizable medium of mercury vapor and an inert gas such as argon. Although the envelope 10 is in the general shape of an incandescent lamp any transparent sealed envelope such as a toroid can be used.

The interior surface of the envelope 10 is coated first with an electrically insulative ultraviolet light reflective material 13 such as magnesium oxide and then with a fluorescent light emitting material 12 selected from conventional halophosphates such as fluorophosphates.

An induction coil 14 is secured in position inside envelope 10 by a non-conductive supporting stem 16 that is anchored to a lamp base structure 20. The exposed surface of the stem 16 is coated with a layer 24 of ultraviolet reflective material to enhance lamp efficiency. Microwave shielding coaxial cable 18 is embedded in the stem 16 and carries power from a radio frequency (r.f.) energy source (not shown) housed in the lamp base 20 to the coil 14. The energy source comprises a radio frequency oscillator of the type described by Hollister in U.S. Pat. No. 4,010,400 and having an output driver stage and a tuned circuit including the toroidal induction coil 14. The power source housing 20 has screw threads 22 and an electrical contact 26 that makes contact with and delivers electrical power from conventional incandescent light bulb sockets to the r.f. power source.

Figure 4:
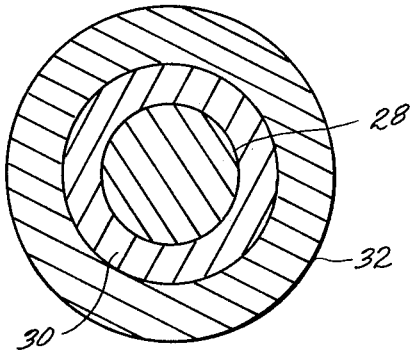
FIG. 4 is a cross-section of the induction coil wire.

Upon application of electrical power to the r.f. energy source an electrical field sufficient to initiate ionization of the mercury appears across the induction coil 14. After an arc discharge is established in the mercury vapor, energy from the r.f. oscillator is coupled to the discharge through the magnetic induction field generated in the coil 14. The ionized medium emits ultraviolet light that travels to the phosphor coating 12 on the envelope where it excites the phosphor coating causing it to emit white light. The portion of the ultraviolet light not absorbed by the coating 12 is reflected back into the envelope by the reflecting layer 13 without passing through the glass wall of the envelope 10. To enhance efficiency of the lamp, a reflecting surface 24 is deposited on the stem 16 and an ultraviolet reflecting surface 32 is superimposed on an electrical insulation layer 30 of the wire 28, used to wind the coil (FIG. 4). Lamp efficiency is thereby improved by minimizing any absorption phenomena that may occur at the coil or stem. Since the coil is placed at the center of the lamp and there is some space between the coil 14 and the envelope 10, the shadow of the coil will not be visible when the lamp is lighted. The wire insulation layer 30 can be selected from several of the known wire insulators such as lacquer.

The current state of the art in techniques for generating induction fields required by electrodeless fluorescent lamps places a limitation on safety and health standards that such lamps can achieve. The microwave leakage, characterizing lamps that use cylindrical coils diminishes their overall utility. Below it is shown how the electrodeless fluorescent lamp described herein minimizes the problem of leakage radiation by the use of a toroidally wound helical coil.

Figure 2:
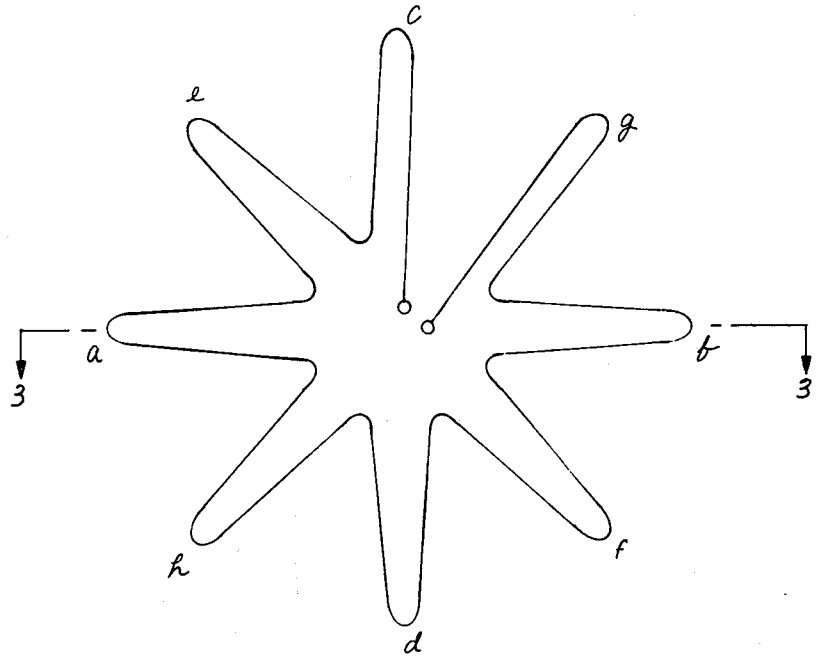
FIG. 2 is a top view of the induction coil on line 2—2 of FIG. 1.

It is reasonably straightforward to show why the leakage radiation from the toroidal coil is negligible. Viewing the coil from above as in FIG. 2, i.e., along axis 2—2 in FIG. 1, the coil appears as a progression of loops. The induced electromagnetic lines of flux outside the coil due to coil element "a" are cancelled by the lines of flux induced by coil element "b" which is directly opposite coil element "a". The cancellation phenomena applies to all the corresponding coils, i.e. "c" cancels "d", "e" cancels "f", etc. Therefore, if good symmetry is maintained, the field intensity at a point along the 2—2 axis above or below the toroid is zero.

Figure 5:
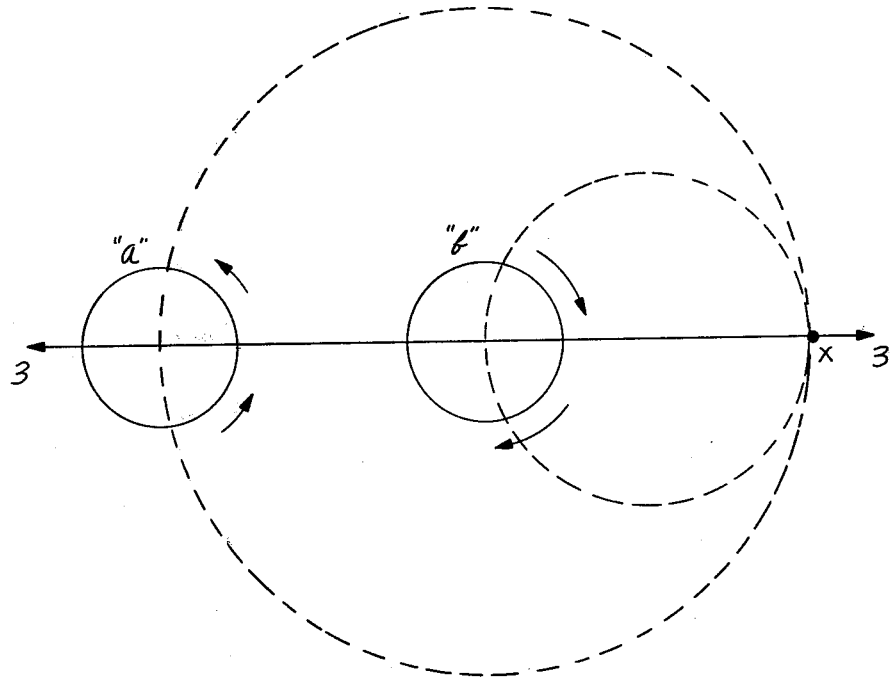
FIG. 5 is a magnetic field pattern at a point distant from two conductors.

A second radiation consideration is taken by viewing coils "a" and "b" in a direction perpendicular to axis 2—2. The resulting surfaces and representative flux pattern at a point x along axis 3—3 is illustrated in FIG. 5. The field generated by coil element "a" is cancelled by that from coil element "b". The cancellation however, is not total, because the distances from a point distant from each coil is not identical. However, as the distance from the lamp increases, the differential field becomes negligible. At distances of about two feet from the lamp, cancellation is complete.

Figure 6:
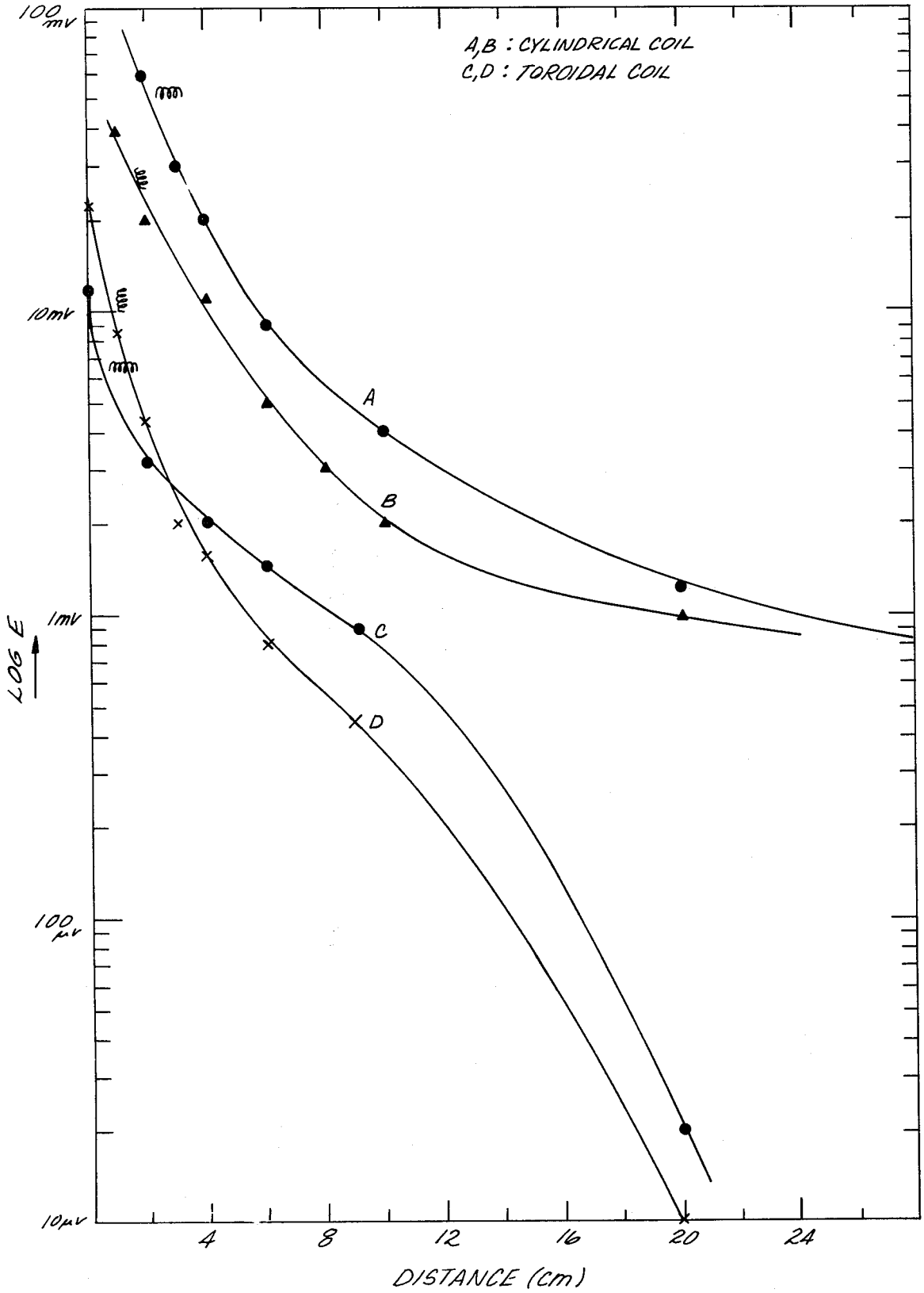
FIG. 6 is a plot of radio frequency field intensity versus coil distance for cylindrical and toroidal coils in both horizontal and vertical orientations.

Laboratory demonstration of the phenomena heretofore described is illustrated graphically in FIG. 6. The ordinate scaled in logrithmic graduations represents a voltage measurement using a volt meter connected to a field sensing coil that is sensitive to magnetically induced fields and the abscissa linearly graduated, is a measure of the distance between the energized induction coils under test and the sensing device.

Plots A and B refer to a cylindrical induction coil wherein the tests were performed with the induction coil axis placed in a horizontal and vertical orientation respectively. Plots C and D refer to a toroidal helix tested using the same technique. Both induction and toroidal coils were wound with 20 turns of identical wire in order to obtain similar inductance values and were both energized using a high frequency power supply delivering 500 milliwatts of power at 10 megahertz. It is observed that at a distance of about 20 cm from the coil, the field radiation intensity of the toroid is lower by about two orders of magnitude as compared with that generated by the cylindrical coil and continues to decrease far more rapidly as a function of source distance. As further observed in FIG. 6, coil orientation has only minor effects on field intensity values. On this basis, the present invention significantly ameliorates the problem of microwave radiation encountered when using cylindrical induction coils.

In one embodiment the toroidal coil is used in conjunction with sealed envelopes in the general shape of an incandescent lamp. In such a case, the toroid must be placed within the envelope in order to couple the field generated within the coil with the mercury vapor. For optimum operation in such an application the toroidal induction coil 14 is wound with about 10 to 20 turns. Fewer than about 10 turns yields a coil which is characterized by a low inductance value which can result in impedance mismatching between the coil and the r.f. power source. Additionally, fewer than about 10 turns results in field radiation patterns which require greater source distances before complete cancellation occurs. More than about 20 coil turns, although improving radiation characteristics, adversely effects light generation in the lamp. Additional windings in a toroidal coil of fixed dimensions results in a reduction of the spacing between adjacent windings thereby constricting the space through which ultraviolet radiation, generated within the coil, can pass. Therefore, if the spacings are too small, the level of ultraviolet radiation escaping into the envelope will be insufficient to adequately excite the light producing phosphorus.

Figure 3:
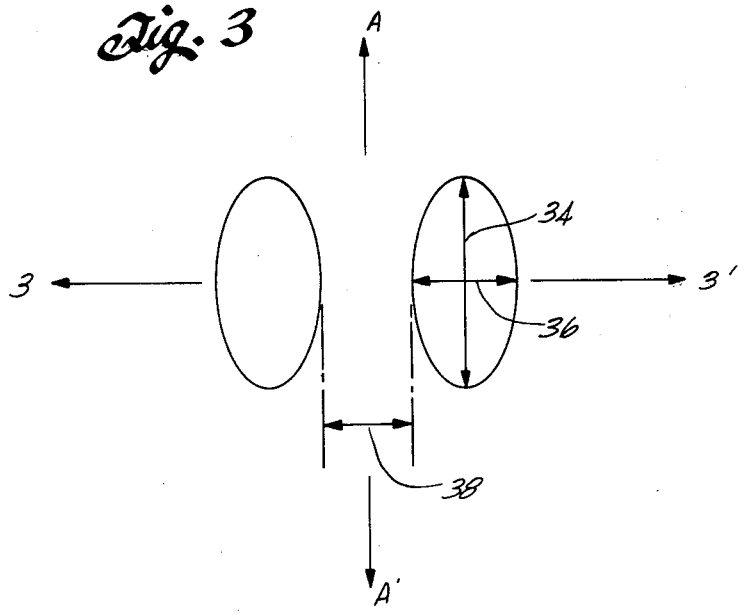
FIG. 3 is a sectional view of the induction coil taken on the line 3—3 of FIG. 2.

To accomodate insertion and positioning of the coil in light bulbs of the shape used in standard incandescent lamps, the cross-section of the toroid is modified from circular to elliptical as is shown in FIG. 3. This structural shape consideration gives rise to elliptical surfaces defined by the major axes 34 in the range of about 1 to 1½ inches, the minor axes 36 in the range of about ⅜ to ¾ inches and the distance 38 separating the two ellipses in the range of about ⅛ to ¼ inches.

Selection of the size of the coil wire 28 is made on the basis of its ability to be structurally self-supporting as well as having a current carrying capacity in the range of about ¼ amperes. To prevent stress corrosion by mercury vapor and to prevent electrical short circuiting of adjacent coil windings, should they contact, an initial electrical insulating coating 30 is placed on the wire. In the preferred embodiment the wire size is in the range of about 25 mils in diameter, which in standard sizing tables is 22 guage.

Figure 7:
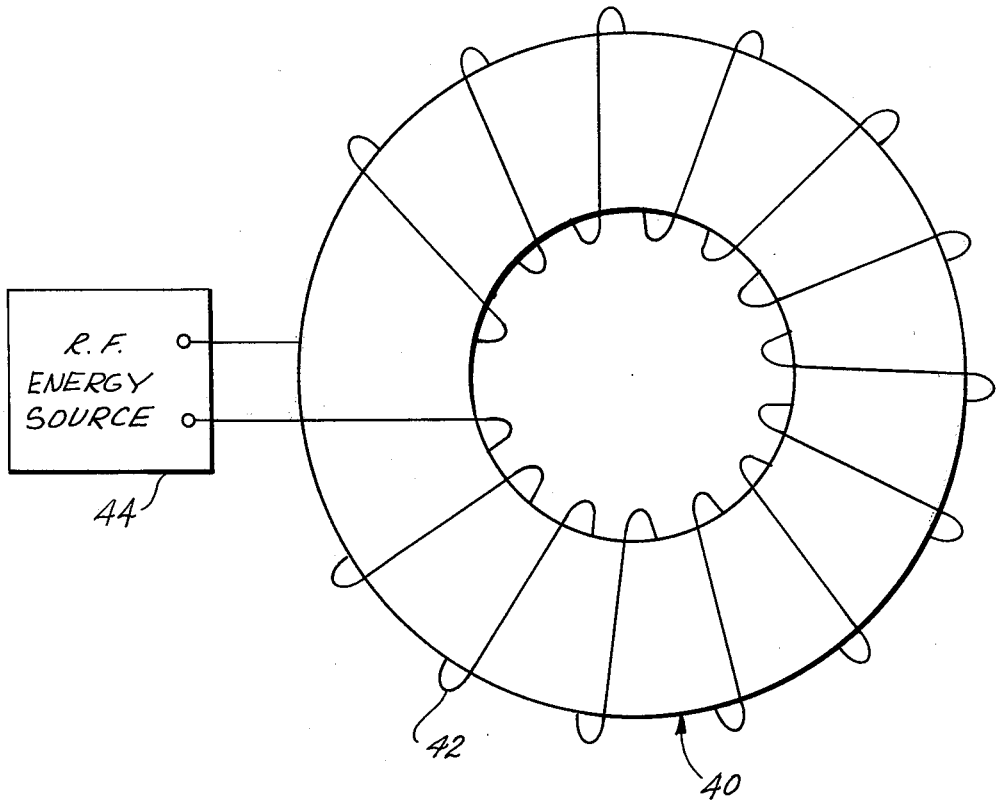
FIG. 7 is a view of the toroidal coil wrapped about a toroidal fluorescent lamp.

An alternate embodiment of the invention shown in FIG. 7 has a sealed envelope identical to the envelope, heretofore described, except that it is in the general shape of a toroid. A coil wire 42 helically wound about the envelope is energized by an r.f. energy source 44. Since the envelope lies completely within the magnetic field generated by the coil, maximum coupling to the ionizable medium is accomplished without immersion of the coil in the medium. For optimum operation, the coil should be wound with the number of turns required to provide coil inductance values necessary to avoid serious mismatching with the r.f. source. Toroidal lamps are available in many sizes and one skilled in the art can readily calculate the appropriate number of coil windings to insure proper impedance matching between the coil and r.f. source.

Although a presently preferred embodiment of this invention has been described herein, many modifications and variations will be apparent to one skilled in the art and therefore, the spirit and scope of the appended claims should not be necessarily limited to the description of the preferred version contained herein.

What is claimed is:

1. An electrodeless fluorescent lamp comprising:

a sealed transparent envelope, an ionizable medium within the envelope, a coating of fluorescent light emitting phosphor on the interior surface of the envelope and luminously responsive to the ionized medium, an induction coil wound in the form of a toroidal helix for generating a magnetic induction field and positioned so that at least a portion of the ionizable medium is within the boundaries of the toroid defined by the helical coil, and means for coupling electrical energy at radio frequency to said induction coil.

2. The device of claim 1 wherein the toroidal coil is placed within the sealed envelope to directly couple with the ionizing medium.

3. An electrodeless fluorescent lamp comprising:

a sealed transparent envelope, an ionizable medium within the envelope, a coating of fluorescent light emitting phosphor on the interior surface of the envelope and luminously responsive to the ionized medium, an induction coil wound in the form of a toroidal helix and placed within the sealed envelope to directly couple with the ionizing medium, said coil for generating a magnetic induction field and positioned so that a substantial portion of its magnetic induction field passes through the ionizable medium, said toroidal coil formed of insulated electrical wire having an ultraviolet reflective surface, and means for coupling electrical energy at radio frequency to said induction coil.

4. The device as described in claim 3 wherein the number of turns of the toroidal helix is in the range of about 10 to 20.

5. The device as described in claim 4, wherein the surfaces of the toroidal coil defined by a plane passing through the toroid axis and parallel therewith forms two similar ellipses, the major axis of each ellipse being in a generally vertical orientation and having a length in the range of about 1 to 1½ inches, the minor axis of each ellipse being in a generally horizontal orientation and having a length in the range of about ⅜ to ¾ inch with the distance separating the two ellipses in the range of about ⅛ to ¼ inch.

6. The device as described in claim 5, wherein the wire is of adequate gauge to be structurally self-supporting and capable of carrying about ¼ amperes.

7. The device as described in claim 5 wherein the wire size is 22 guage.

8. An improved electrodeless fluorescent lamp of the type having a sealed transparent envelope containing an ionizable medium and internally coated with a light emitting phosphor, luminously responsive to such an ionizable medium for emitting radiant energy when subjected to a radio frequency field wherein the improvement comprises an induction coil wound in the form of a toroidal helix positioned so that at least a portion of the ionizable medium is within the boundaries of the toroid defined by the helical coil.

9. An improved electrodeless fluorescent lamp of the type having a sealed transparent envelope containing an ionizable medium and internally coated with a light emitting phosphor, luminously responsive to such an ionizable medium for emitting radiant energy when subjected to a radio frequency field wherein the improvement comprises an induction coil wound in the form of a toroidal helix and placed within the sealed envelope to directly couple with the ionizing medium.

10. An improved electrodeless fluorescent lamp of the type having a sealed transparent envelope containing an ionizable medium and internally coated with a light emitting phosphor, luminously responsive to such an ionizable medium for emitting radiant energy when subjected to a radio frequency field wherein the improvement comprises an induction coil wound in the form of a toroidal helix and placed within the sealed envelope to directly couple with the ionizing medium, said toroidal helix formed of insulated electrical wire having a coating of ultraviolet reflecting material superposed over a coating of electrical insulation material.

11. The device as described in claim 10, wherein the number of turns of the toroidal coil is in the range of about 10 to 20.

12. The device as described in claim 11, wherein the surfaces of the toroidal coil defined by a plane passing through the toroid axis and parallel therewith forms two similar ellipses, the major axis of each ellipse being in a generally vertical orientation and having a length in the range of about 1 to 1½ inches, the minor axis of each ellipse being in a generally horizontal orientation and having a length in the range of about ⅜ to ¾ inch with the distance separating the two ellipses in the range of about ⅛ to ¼ inch.

13. The device as described in claim 12, wherein the wire is of adequate gauge to be structurally self-supporting and capable of carrying about ¼ amperes.

14. The device as described in claim 13 wherein the wire size is 22 gauge.

* * * * *